US005647967A

United States Patent [19]

Murase et al.

[11] Patent Number: 5,647,967

[45] Date of Patent: Jul. 15, 1997

[54] PLATING METHOD FOR CYLINDER

[75] Inventors: Yasuyuki Murase; Masaaki Isobe, both of Iwata, Japan

[73] Assignee: Yamaha Hatsudoki Kabushiki Kaisha, Shizuoka, Japan

[21] Appl. No.: 299,838

[22] Filed: Sep. 1, 1994

[30] Foreign Application Priority Data

Sep. 2, 1993 [JP] Japan ..... 5-218753
Jun. 17, 1994 [JP] Japan ..... 6-136022

[51] Int. Cl.[6] ..... C25D 3/12; C25D 5/02

[52] U.S. Cl. ..... 205/131; 205/148; 205/151; 205/271; 205/273

[58] Field of Search ..... 205/148, 256, 205/271, 273, 131, 151

[56] References Cited

U.S. PATENT DOCUMENTS

| | | | |
|---|---|---|---|
| 1,379,050 | 5/1921 | Schulte | 205/271 |
| 3,362,893 | 1/1968 | Amaro et al. | 205/258 |
| 3,922,208 | 11/1975 | Cordone et al. | 205/148 |
| 4,160,704 | 7/1979 | Kuo et al. | 205/271 |
| 4,222,828 | 9/1980 | Zuurdeeg | 205/273 |
| 4,404,067 | 9/1983 | Enomoto | 205/273 |
| 4,415,423 | 11/1983 | Brooks | 205/148 |
| 4,786,324 | 11/1988 | Rieger | 205/258 |
| 4,908,280 | 3/1990 | Omura et al. | 205/258 |
| 4,990,226 | 2/1991 | Byler et al. | 205/271 |

OTHER PUBLICATIONS

Lowenheim, "Electroplating", p. 139, (1978).

*Primary Examiner*—T. Tung
*Attorney, Agent, or Firm*—Knobbe, Martens, Olson & Bear, LLP

[57] ABSTRACT

A plating liquid for forming a nickel plating layer containing a dispersed substance and phosphorus having 1.0 g/l or more of sodium is desirably utilized in the high speed plating process. Other important aspects of the invention include a plating method using the aforementioned plating liquid, characterized in that a voltage is impressed while permitting the plating liquid to flow between a surface to be plated of a workpiece at a plating liquid flow rate of 1.0–3.0 m/sec and an electric current density of 20–200 A/dm$^2$, and an engine cylinder having a plated interior surface characterized in that the plating layer of the cylinder is formed by a high speed plating treatment using the aforementioned plating liquid.

7 Claims, 11 Drawing Sheets

PLATING METHOD FOR CYLINDER

FIELD OF THE INVENTION

This invention relates to surface treatment methods, devices and liquids used therein and, in particular, to such methods, devices and liquids used in the process of nickel plating the interior surfaces of cylinders of internal combustion engine blocks.

BACKGROUND OF THE INVENTION

While engine and cylinders are often formed by chrome plating, it is desirable to use a plated coating which contains a dispersed eutectoid substance and phosphorus and, in particular, a Ni—P—SiC plated coating which contains nickel and phosphorus and in which the silicon carbon eutectoid is dispersed. This plating provides excellent lubricity and frictional properties.

Although such plating has desirable properties, the nature of the plating must compete with the desire to increase the speed of the plating process.

Historically, plating processes were relatively slow and, therefore, were not possible in a general assembly line environment. Accordingly, parts to be plated were removed from the assembly line, transported to plating treatment locations and later retransported and replaced on the assembly line. This obviously is undersirable.

Thus, there is needed an improved plating method, which will provide for a plating surface having the desired characteristics, within the time restraints of a high speed plating process.

SUMMARY OF THE INVENTION

The limitations of the prior art, are overcome through a plating liquid for forming a nickel plating layer containing a dispersed substance and phosphorus, characterized in that the nickel plating liquid contains 1.0 g/l or more of sodium in addition to a dispersed substance forming material and phosphorus. This plating liquid creates the desired high quality plating surface within the constraints of a high speed plating process.

Other important aspects of the invention include a plating method using the aforementioned plating liquid, characterized in that a voltage is impressed while permitting the plating liquid to flow between a surface to be plated of a workpiece at a plating liquid flow rate of 1.0–3.0 m/sec and an electric current density of 20–200 A/dm$^2$, and an engine cylinder having a plated interior surface characterized in that the plating layer of the cylinder is formed by a high speed plating treatment using the aforementioned plating liquid.

DETAILED DESCRIPTION OF THE PREFERRED EMBODIMENT

Figure 1:
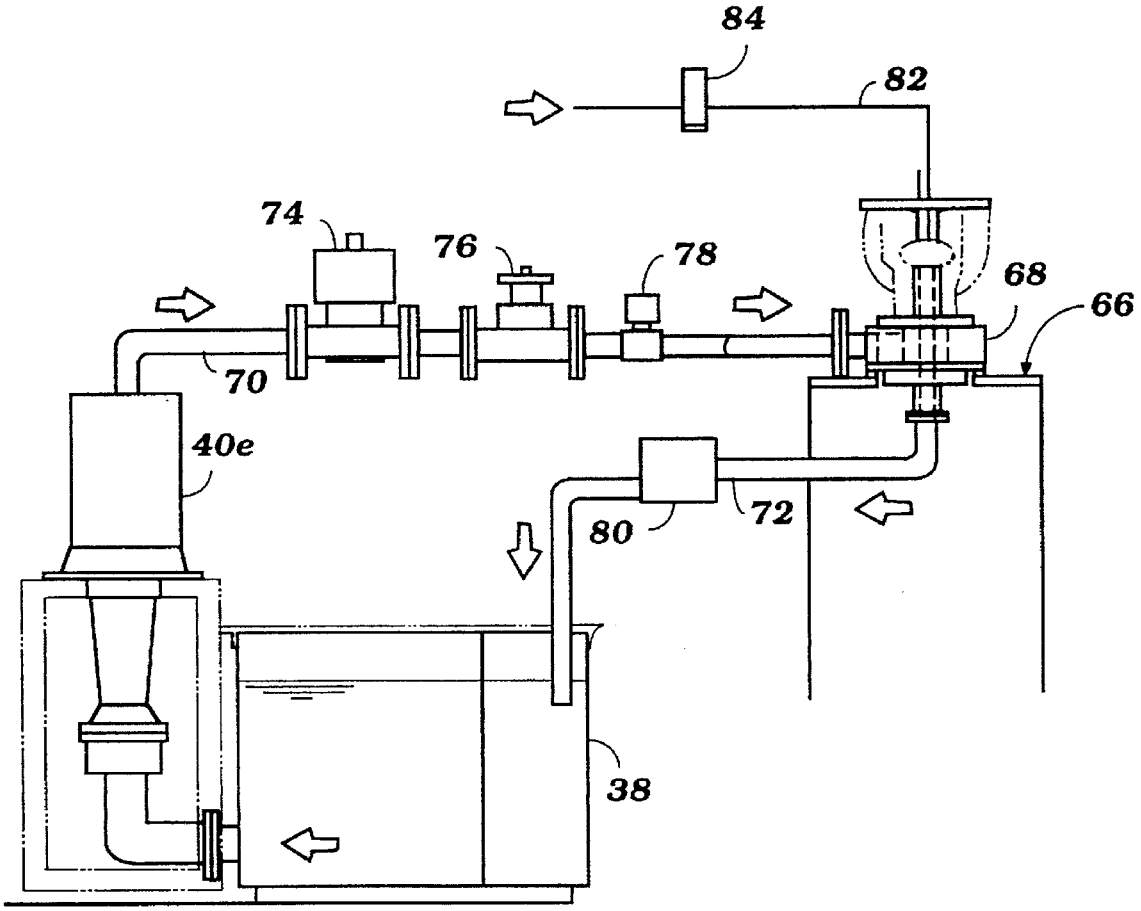
FIG. 1 is a schematic view illustrating the fluid transfer assembly of a plating workstation of the system of FIG. 1.
Figure 2:
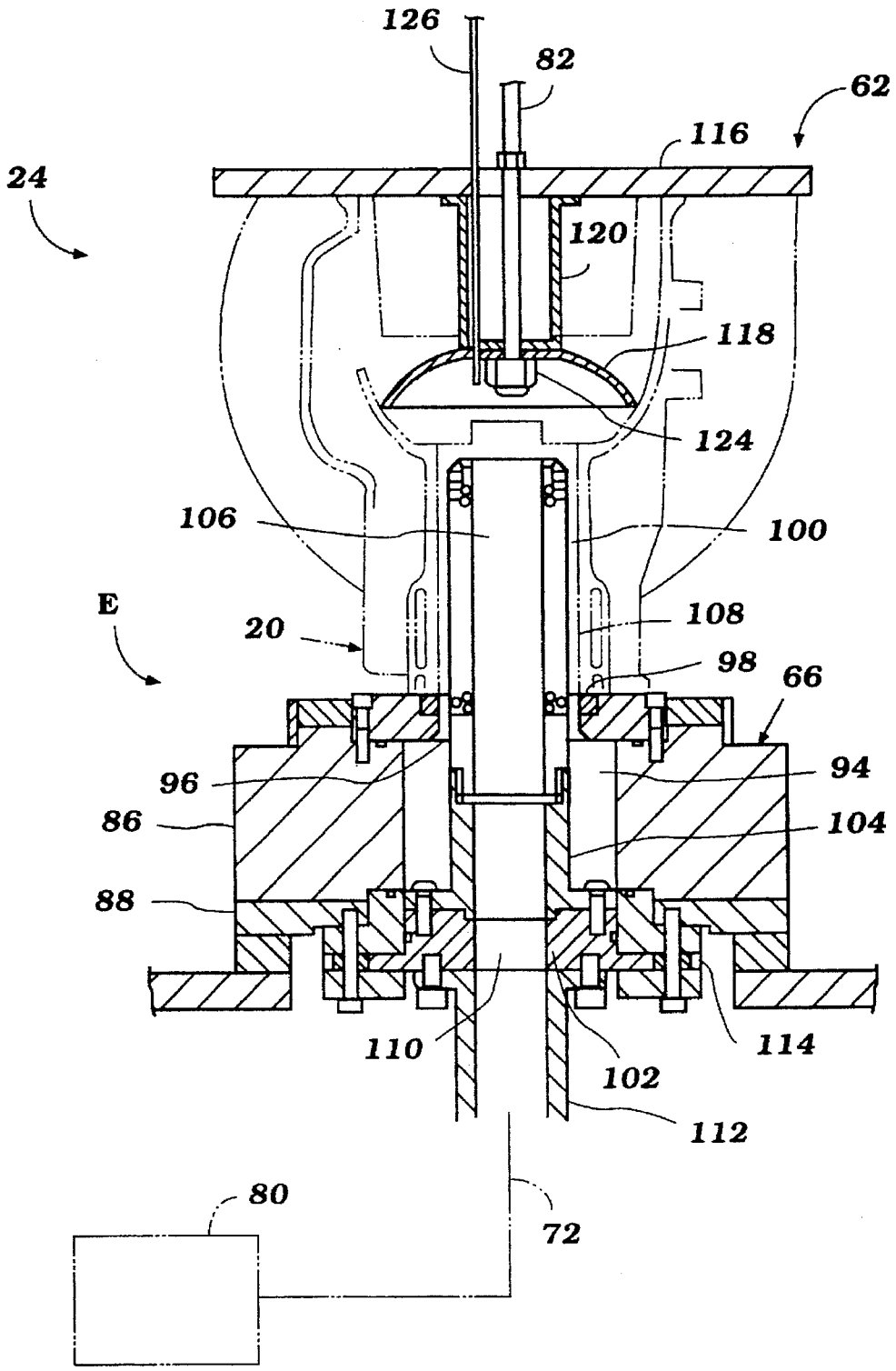
FIG. 2 is an elevational, vertical cross-sectional view showing one embodiment of a surface treatment device according to the present invention applied to a plating workstation.

FIGS. 1–2 illustrate a workstation for a system particularly adapted to perform a high speed plating process incorporating nickel and, as a dispersing agent, silicon carbide and phosphorous. This plating material is desirable for reasons of hardness and resistance to baking of the inside of the cylinder, as previously discussed.

FIG. 1 schematically illustrates the fluid transfer assembly for a plating workstation. The treatment device or workstation has a main body 66, including a work-supporting portion 68 at the upper end thereof. The treatment fluid reservoir 38 is connected to the workstation by a liquid feed pipe 70 and a treating liquid recovery pipe 72. The pump 40*e* along the treating liquid feed channel or pipe 70 pumps treating liquid from the reservoir 38 to the workstation. The treating liquid feed pipe 70 is further provided with a main automatic valve 74 and a main manual valve 76 for adjusting the feed rate of the treating fluid, with a flow rate sensor 78 for detecting the flow rate of the treating liquid. Downstream of the main body 66 of the workstation, the treating liquid recovery channel or pipe 72 likewise communicates with the treating fluid reservoir 38. Advantageously, located along the recovery pipe 72 is a suction pump 80 for forcibly suctioning treating liquid from the treatment device main body.

As discussed below in greater detail, there is also provided a washing water feeding pipe 82 for feeding washing water to the cylinder block 20. The washing water feed pipe 82 has a downstream end connected to the jig 62 and an upstream end connected to a source of washing water (not shown). An automatic valve 84 is disposed between the source of washing water and the jig 62 for adjusting the flow rate of washing water. As will be appreciated, after washing, the washing water is passed through the recovery pipe 72. To prevent the wash water from diluting the concentration of the treating fluid, the treating fluid reservoir 38 is equipped with a concentrating device (not shown) to remove a quantity of water corresponding to the washing water flowing into the tank, by means of evaporation.

Figure 3:
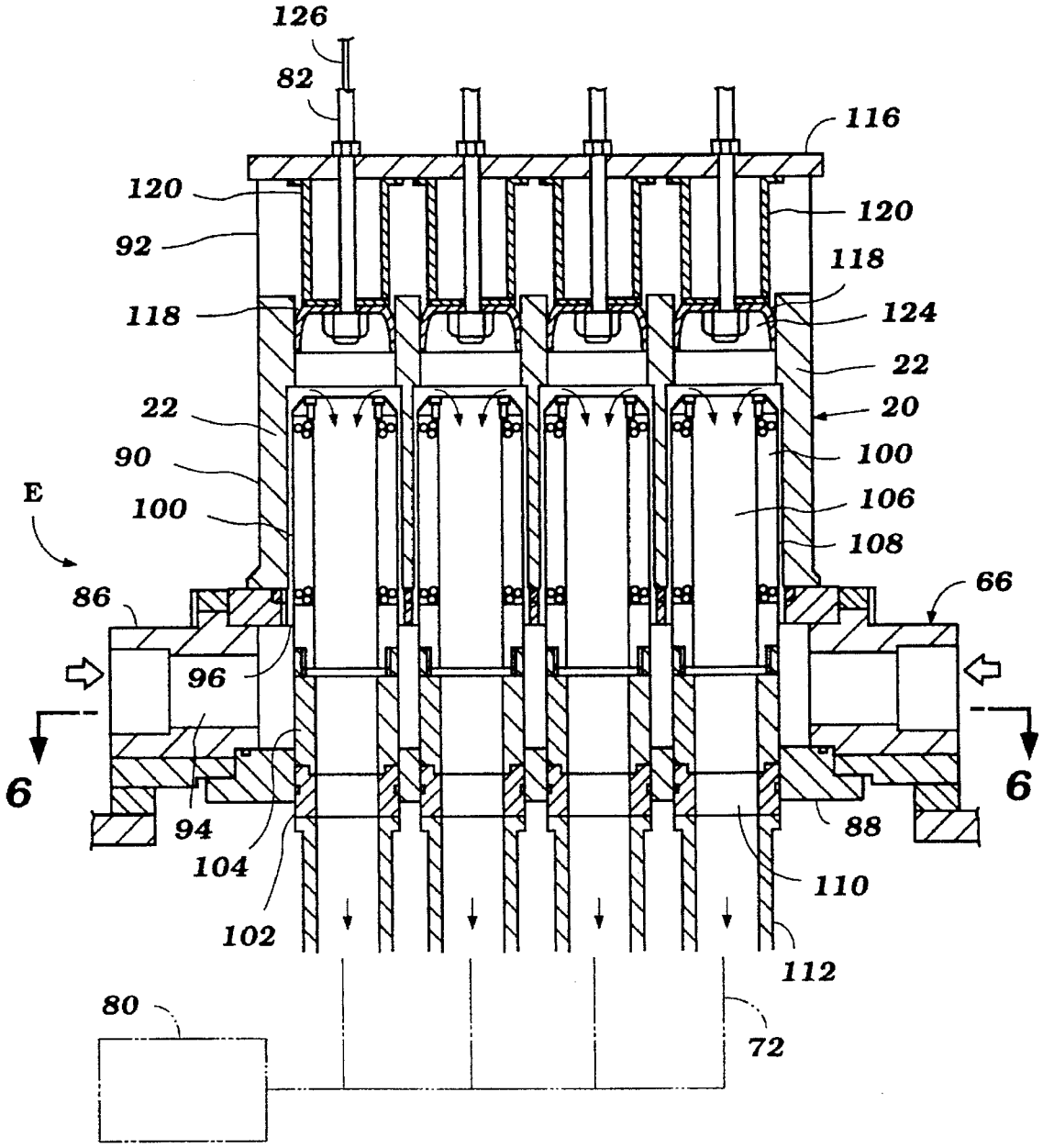
FIG. 3 is a vertical cross-sectional side view of the surface treatment device of FIG. 2.

FIGS. 2 and 3 illustrate a detailed structure of the plating workstation 24. A work support portion or supporting block 86 is mounted on a base table 88 of the workstation main body 66. The cylinder block 20 is adapted to be supported on the supporting block 86, with both open portions of each cylinder 22 maintained in a predetermined vertically oriented state. Specifically, the cylinder block 20 has a unitary structure composed of a cylinder-defining portion 90 defining four cylinders 22 and a skirt-like crankcase portion 92. The cylinder block 20 is inverted from the position it will be mounted in the automobile, and the jig 62 is connected to the upper end of the crankcase.

The supporting block 86 defines a laterally extending (in the direction along which the cylinders are arranged) treating liquid feed path 94 positioned beneath the cylinder portion 90 of the cylinder block 20. Both ends of the liquid feed path 94 are connected to the treating liquid feed pipe 70 (see FIG. 1). The support block 86 defines a series of openings 96 corresponding to the position of each of the cylinders, which is in fluid communication with the treating liquid feed path 94. A seal portion 98 is provided around the periphery of each opening 96. Accordingly, as will be appreciated, when the cylinder block 20 is mounted on the supporting block 86, the lower end of each cylinder (head side of the cylinder) coincides with the corresponding opening 96 in the mounting block with the peripheral edges of each cylinder in sealing engagement with the seal portion 98.

The body of the workstation 24 includes an electrode 100, which also functions as a fluid passage defining member. Each of the electrodes 100 is positioned to correspond to the position of each of the cylinders 22 of the cylinder block 20. The electrodes 100 are likewise formed in a cylindrical shape and are mounted on a holder 102, which in turn is mounted on the table 88 to a mounting member 104. Each electrode 100 extends through the treating liquid feed path 94 and protrudes upward from the corresponding opening 96. Accordingly, when the cylinder block 20 is mounted on the support block 86, each of the electrodes 100 is positioned within a corresponding cylinder 22 of the cylinder block so that the upper end of each electrode is positioned adjacent to an upper end of the cylinder bore with a predetermined space being defined between the outer peripheral surface of the electrode and the inside cylindrical surface defined by the cylinder. As a result, inner and outer cylindrical passages 106, 108 are defined inside and outside each electrode. These inner and outer fluid passages 106, 108 communicate with one another at the upper ends thereof. Furthermore, the outer fluid passage 108 is in fluid communication with the treating liquid feed path 94.

Each of the holders 102 is provided with a through hole which constitutes, together with the inside face of the mounting member 104, a treating liquid discharge path 110 which is in fluid communication with the passage 106 formed within the electrode 100. Each treating liquid discharge path 110 is connected to a respective treating liquid recovery pipe 72 through a connecting pipe 112. The mounting member 104, holder 102, and connecting pipe 112 are formed of an electrically conductive material and are electrically connected to a rectifier. As will be appreciated, to properly orient the electrode, each holder 102 must be precisely positioned with respect to the corresponding cylinder 22 of the cylinder block 20. Further, the electrodes 100 are required to be electrically separated from one another.

As discussed above, while engine and cylinders are often formed by chrome plating, it is desirable to use a plated coating which contains a dispersed eutectoid substance and phosphorus and, in particular, a Ni—P—SiC plated coating which contains nickel and phosphorus and in which the silicon carbon is dispersed. This plating provides excellent lubricity and frictional properties.

Although such plating has desirable properties, the nature of the plating must compete with the desire to increase the speed of the plating process. It is not possible, for example, to use this plating material while increasing the speed of the plating process simply by increasing the electric current density while allowing the plated liquid to flow past the surface to be plated. Specifically, while the increased electric current density will result in the increased deposition speed of nickel, the amount of dispersed substance and the content of phosphorus in the deposition layer do not increase, so that the resulting deposition layer has a decreased percent of dispersed substance and phosphorus. However, as discussed in detail below, the plating system of the present invention can be used to form a high quality nickel plating containing phosphorus and a dispersed substance at high speed, while providing a high quality plated interior surface. This is accomplished in significant part by providing sodium and, in particular, certain levels of sodium to the plating bath. The presence of sodium permits the increased deposition of not only nickel, but silicon carbide as well as phosphorus, thereby providing a surface plating having the desired characteristics.

Figure 4A:
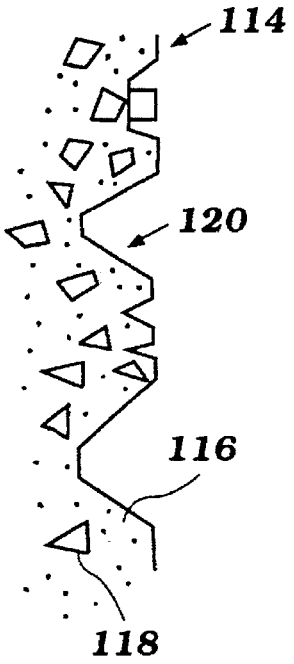
FIGS. 4A and 4B are enlarged cross-sectional views showing a plated coating formed on an inside peripheral surface of the cylinder before abrasion and after abrasion, respectively.
Figure 4B:
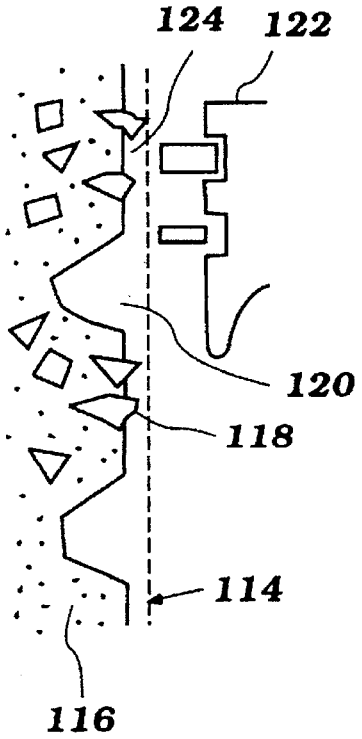

Referring to FIGS. 4*a* and 4*b*, when the inner cylindrical surface of the cylinder of the cylinder block formed of an aluminum cast alloy is plated with the Ni—P—SiC plating, the plating forms a coating 114 composed of a Ni—P matrix 116 and dispersed particles 118 on the inner cylindrical surface of the cylinder, as shown in FIG. 4*a*. Oil pockets 120 are then formed in the plated coating 114 by means of honing for oil lubrication. During use, wear from the reciprocating piston 122 creates new oil pockets 124 between dispersed particles 118, as a result of the nickel phosphorus matrix 116 being abraded, and the harder silicon carbide particles 118 resisting abrasion. Thus, a surface having nickel phosphorus silicon carbide plating can be properly lubricated with oil even after significant wear.

Figure 5:
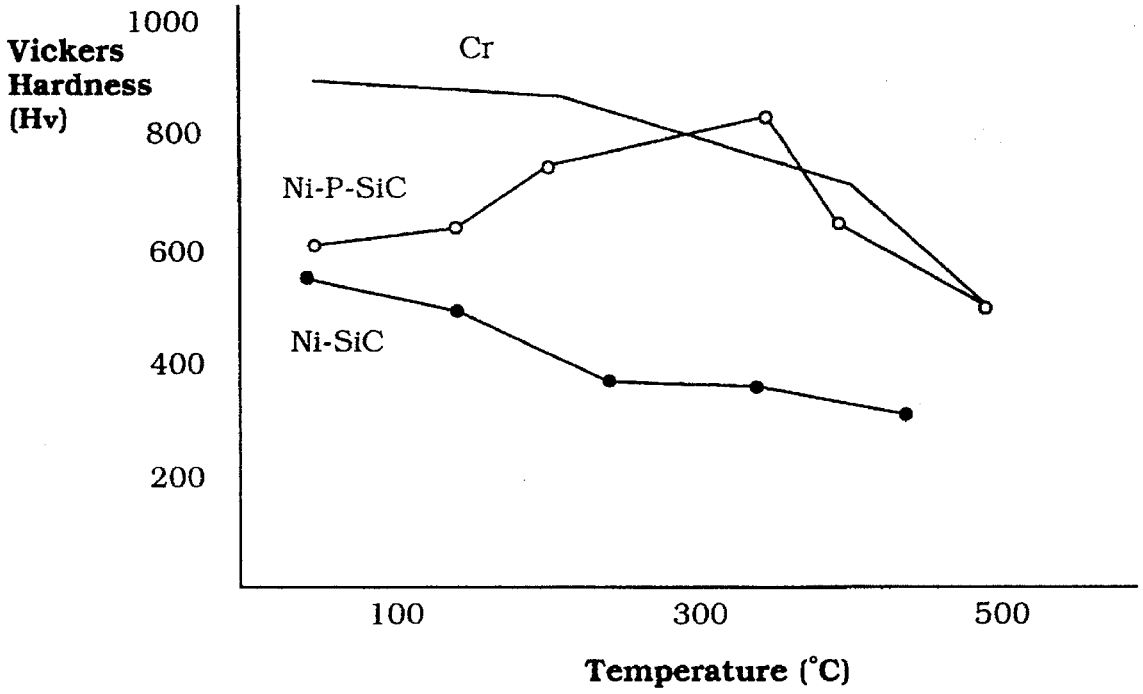
FIG. 5 is a graph showing a relationship between the temperature and the hardness of the plating.

FIG. 5 illustrates the relationship between temperature and the plating hardness in (1) dispersed nickel phosphorus silicon carbide plating, (2) a dispersed nickel silicon carbide plating and (3) a hard chrome plating. As indicated by the graph, when the nickel phosphorus silicon carbide plating is heat treated to 350° C., it provides a greater hardness than the hard chrome plating and shows a much higher hardness than a nickel silicon carbide plating containing no phosphorus. Thus, it will be appreciated that the hardness of the plating surface after heat treatment can be improved by the incorporation of phosphorus in the plating layer.

Figure 6:
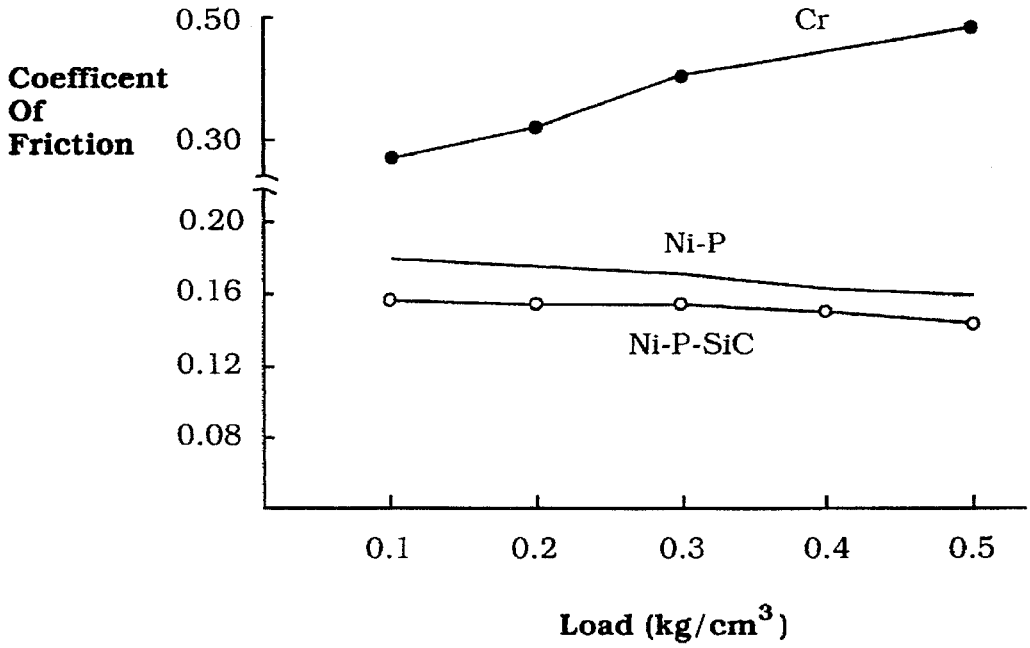
FIG. 6 is a graph showing a relationship between the load and coefficient of friction.

FIG. 6 sets forth a relationship between the load and the coefficient of friction in (1) a dispersed nickel phosphorus silicon carbide plating, (2) a nickel phosphorus plating, and (3) a chrome plating. As indicated by the graph, the coefficient of friction for the nickel phosphorus silicon carbide dispersion plating is smaller than that of the hard chrome plating or the nickel phosphorus plating and, hence, use of this plating can decrease the frictional resistance in the sliding surface.

It has been determined that in order to take advantage of the enhanced lubricity of the nickel plated silicon carbide plating, the amount of silicon carbide should be 1.5–3.5 percent by weight and the hardness should be Hv 600 or more (Hv 800 or more after heat treatment).

Figure 7:
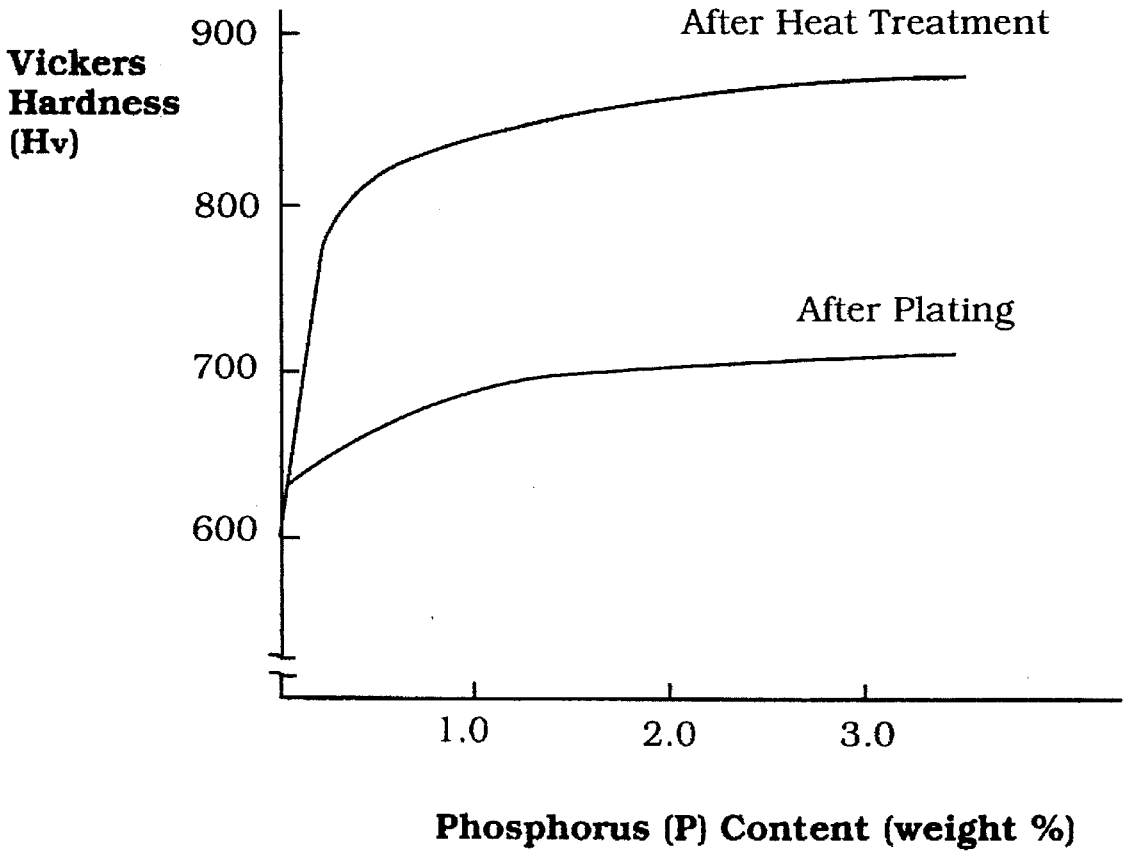
FIG. 7 is a graph showing the relationship between the phosphorous content and the hardness.

FIG. 7 is a graph of the relationship between plating hardness and the content of phosphorus in the plated coating after plating (when the sodium concentration in a plating liquid is 2 grams per liter). As is apparent, as the phosphorus content increases, the hardness increases. Thus, it is desirable to achieve a higher phosphorus content in the plated coating.

In operation, the plating bath to achieve the nickel phosphorus silicon plating is a sulfamic acid bath containing nickel sulfamate as a major component or a sulfuric acid bath containing nickel sulfate as a major component. The bath additionally should contain phosphorus and silicon carbide as a dispersing agent. Sodium hydroxide has sometimes been used for the control of pH in a plating bath.

The preferred composition of and control parameters for the plating bath involve the use of a nickel sulfamate or a nickel sulfate bath having a concentration of the main component of 500–700 grams per liter, a phosphorus concentration and sodium concentration in the plating bath of 0.1–0.3 grams per liter and 1.0–3.5 grams per liter or more respectively, a bath temperature of 65°–80° C. and a pH of 3.0–4.5. The above-described plating liquid is desirably used in a plating system as disclosed in the present application in which the plating liquid flows along the surface of the work being plated. Desirably, the flow speed of the plating liquid relative to the surface to be plated is 1.0–3.0 meters per second and the electric current density applied is 20–200 A/dm$^2$.

The following table illustrates a comparison between the method of the present invention and a conventional plated method:

TABLE 1

| | CONVENTIONAL METHOD | METHOD OF THE EXAMPLE OF THE PRESENT INVENTION |
|---|---|---|
| Plating Bath | sulfamic acid bath | Sulfamic acid bath (sulfuric acid bath) |
| Plating Condition | pH: unknown bath temperature: 57 ± 3° C. | pH: 3.0–4.3 bath temperature: 65–80° C. |
| Flow Speed Between Electrodes | only stirring of the liquid in the tank | 1.0–3.0 m/sec |
| Electric Current Density | 20 A/dm$^2$ or less | 20–200 A/dm$^2$ |
| Treatment Method | immersion in the tank | work and electrode: fix plating liquid: flow |
| Deposition Speed (SiC deposition amount: 2.5 wt %) | 0.5–3 μ/min | 20–30 μ/min |
| Pretreatment | double zinc substitution method | alumite method |

As is evident from the above table, the plating deposition speed at which the desired amount of silicon carbide is obtainable is much higher than in the conventional method. Significantly, by incorporating sodium in the plating bath, the amount of silicon carbide and the phosphorus content can both be increased despite the increase in the plating deposition speed. For example, in the case of silicon carbide of the amount 2.5 percent by weight, the plating deposition speed is as high as 20–30 μ/min.

As discussed above, current density is related to the flow rate of the plating liquid. Specifically, the higher the flow rate of the plating liquid, the higher becomes the current density. When the flow rate of the plating liquid is 1 meter per second (current density of 20 A/dm$^2$) or more, the plating deposition speed can be accelerated. When the flow rate of the plating liquid exceeds 3 meters per second (current density of 200 A/dm$^2$), however, the amount of silicon carbide tends to significantly decrease so that it is difficult to ensure a high amount of the silicon carbide even with the addition of sodium. Thus, the full rate of the plating liquid and the current density are preferably in the ranges set forth above.

The effect of incorporation on the plating bath will now be described with reference to FIGS. 8–12. These figures show the results of experiments conducted under the following conditions:

(1) Plating bath: nickel sulfamate about 500 grams per liter (2) Bath temperature: about 70° C.

(3) Flow speed of plating liquid between electrodes: about 2.5 meters per second (4) Electric current density: about 100 A per d$\sqrt{m}$ (5) pH: 4.0

Figure 8:
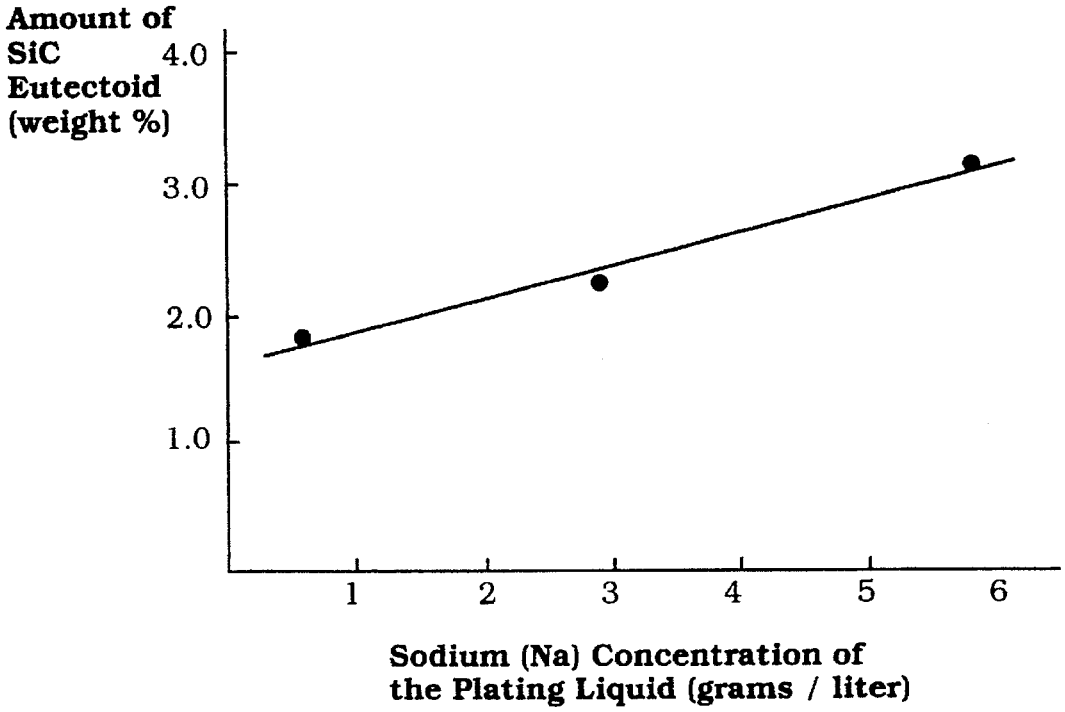
FIG. 8 is a graph showing a relationship between the silicon concentration of the plating liquid and the amount of SiC eutectoid in the plating.

FIG. 8 graphs the relationship between the concentration of sodium in the plating liquid and the amount of silicon carbide in the plated coating (when the silicon carbide concentration in the plating liquid is 150 grams per liter).

Figure 9:
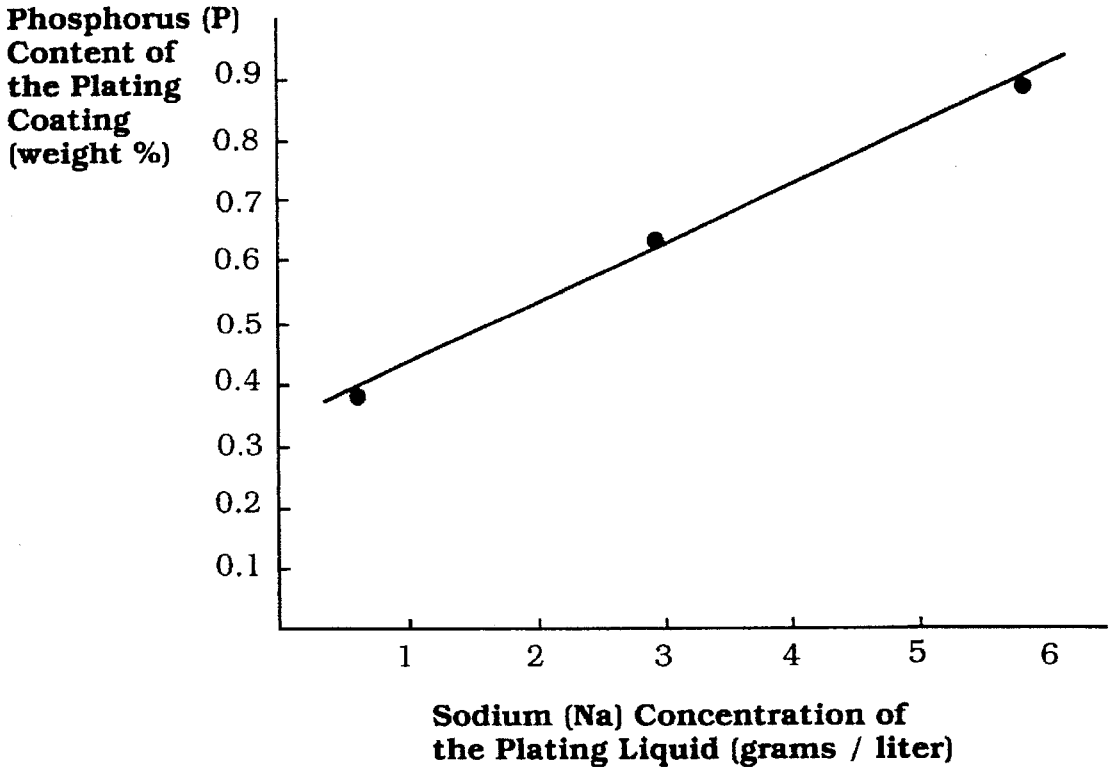
FIG. 9 is a graph showing a relationship between the sodium concentration of the plating liquid and the phosphorous content of the plated coating.

FIG. 9 is a graph of the relationship between the concentration of sodium in the plating liquid and the amount of phosphorus in the plated coating (when the phosphorus concentration in the plating liquid is 0.3 grams per liter). As will be appreciated from the results of the experiments, both the amount of silicon carbide and the amount of phosphorus in the plated coating increase with the increase of the sodium concentration in the plating liquid. Significantly, this sodium concentration in the plating liquid of 1.0 grams per liter or more is significantly higher than that obtained as the result of the prior art practice of adding sodium hydroxide to the plating bath for purposes of controlling the pH in the plating bath. Significantly, this increased level of sodium results in a dramatically increased level of silicon carbide and phosphorus being deposited under the above-described plating conditions.

Figure 10:
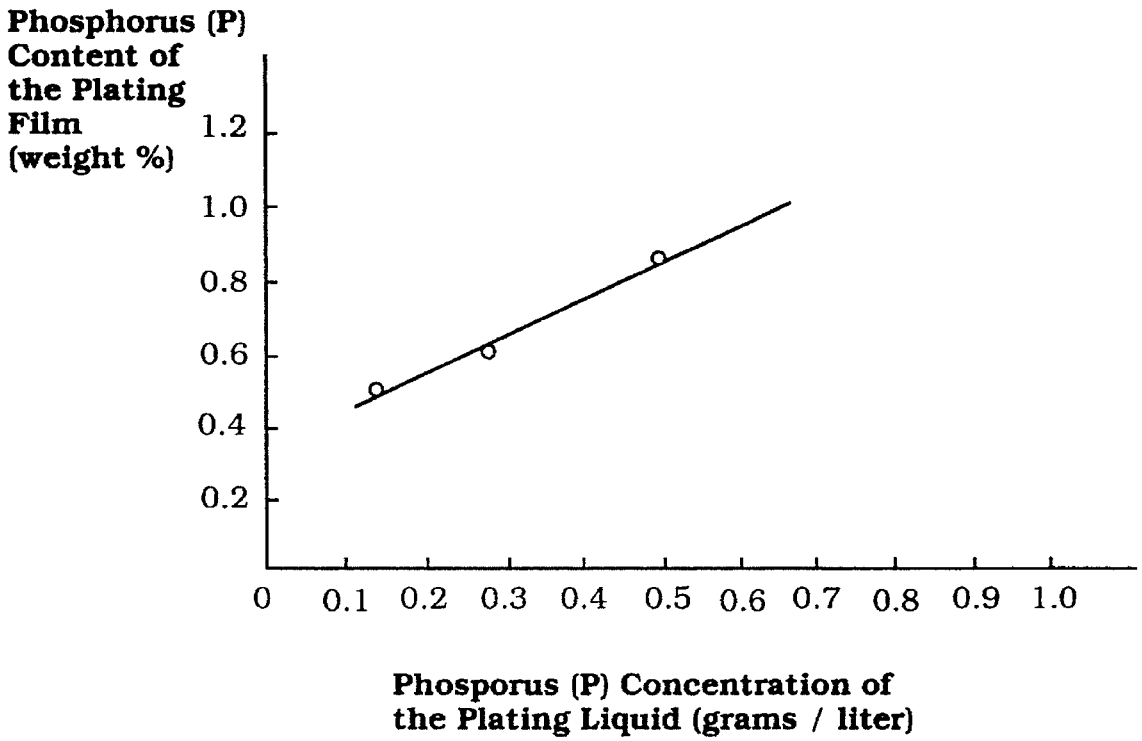
FIG. 10 is a graph showing a relationship between the phosphorous concentration of the plating liquid and the phosphorous content of the plated film.

FIG. 10 is a graph of the relationship between the phosphorus concentration in the plating liquid and the phosphorus content in the plated coating where no sodium is added.

Figure 11:
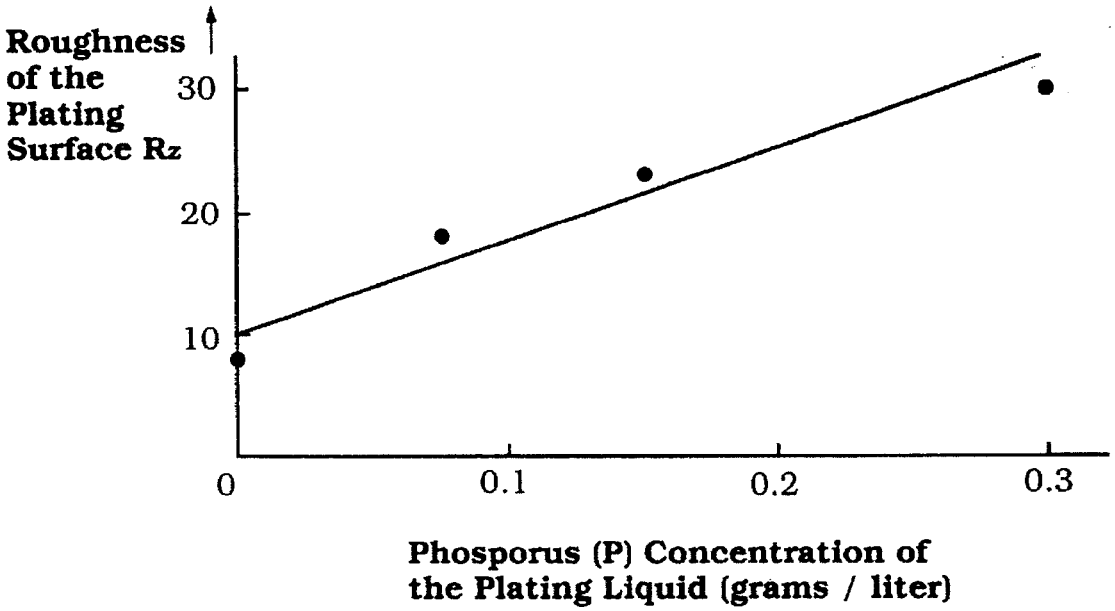
FIG. 11 is a graph showing a relationship between the phosphorous concentration of the plating liquid and the roughness of the plated surface.

FIG. 11 is a graph showing the relationship between the phosphorus concentration in the plating liquid and the roughness of the plated surface where no sodium is added.

Figure 12:
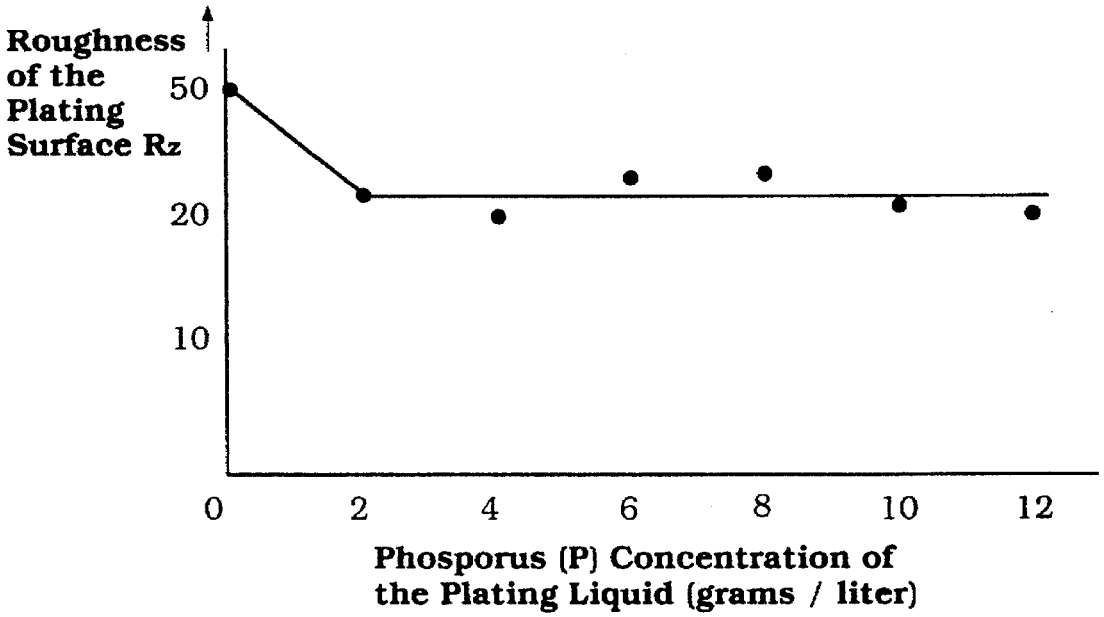
FIG. 12 is a graph showing a relationship between the sodium concentration of the plating liquid and the hardness of the plated surface.

FIG. 12 is a graph of the relationship between the sodium concentration in the plating liquid and the roughness of the plated surface (wherein the phosphorus concentration in the plating liquid is 0.3 grams per liter).

As indicated by the results of the experiment set forth in the foregoing Figures, the phosphorus content of a plated film can be increased by an increase in the concentration of phosphorus in the plating liquid. However, as indicated by the graph of FIG. 11, the increase in the phosphorus concentration in the plating liquid causes an increase in the roughness of the plated surface. This accelerates enlargement of the plating in edge portions of the work, resulting in difficulties in honing the plated workpiece after plating. However, as indicated by FIG. 12, even a relatively high concentration of sodium in the plating liquid does not effect the roughness of the plated surface. Thus, sodium can be added to the plated liquid to enhance the speed with which the silicon carbide and phosphorus can be deposited, while at the same time maintaining a desired service texture.

Figure 13:
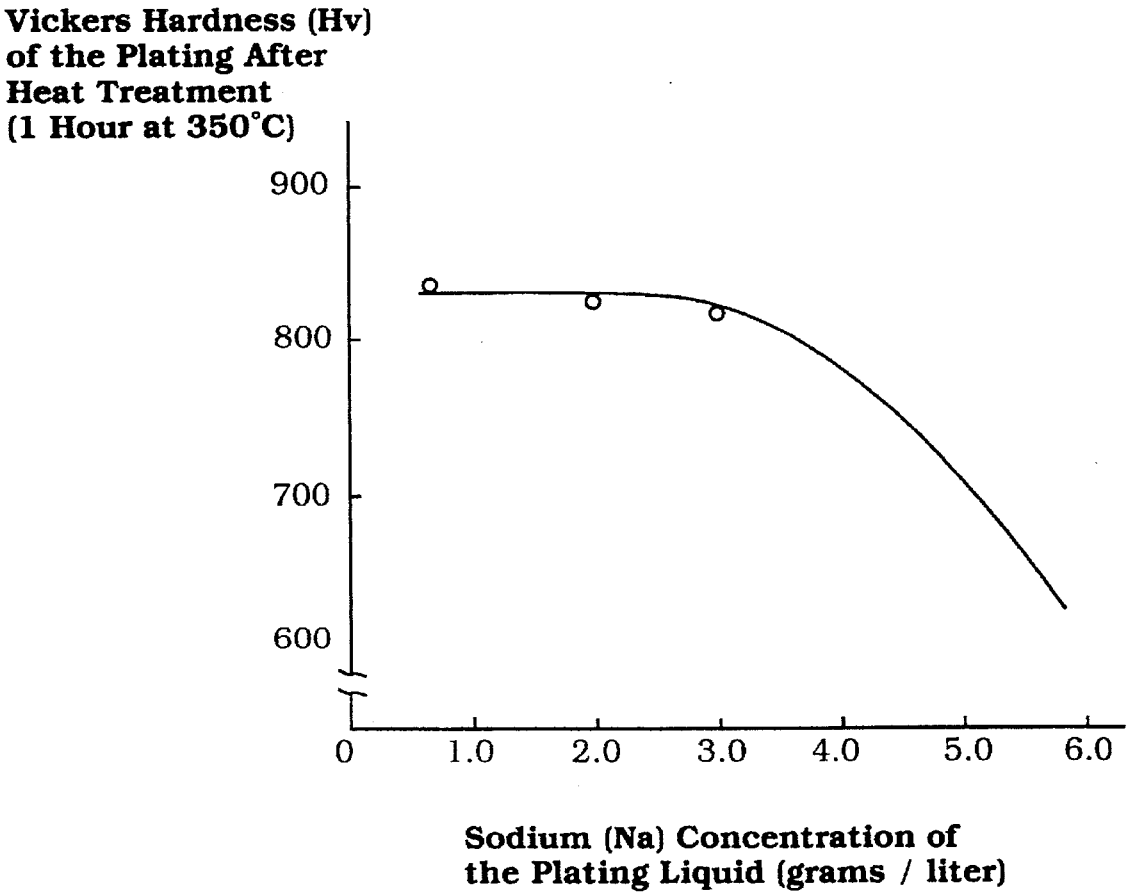
FIG. 13 is a graph showing a relationship between the sodium concentration of the plating liquid and the hardness of the plating after a heat treatment.

FIG. 13 is a graph of the relationship between the sodium concentration and the plating liquid and the hardness of the workpiece after heat treatment of 350° C. for one hour in the case where the phosphorus content of the coating is 0.65 percent by weight. As indicated by the graph, where the sodium concentration of the plating liquid exceeds 3.5 grams per liter the plating has a lower level of hardness. Accordingly, it is desirable that the sodium concentration in the plating liquid be in the range of 1.0–3.5 grams per liter to ensure adequate hardness of the plating layer, while still ensuring the increased level of silicon carbide eutectoid and phosphorus in the plating layer.

As illustrated in Table 2 below, the plated coating has a good level of hardness and surface roughness when the phosphorus content of the plating liquid is 0.1–0.3 grams per liter and the sodium concentration is within the range of 1.0–3.5 grams per liter. Tables 2 and 3 specifically indicate the relationship between the quality of the plated coating and the phosphorus concentration in the plating liquid and the phosphorus content in the coating in the nickel phosphorus silicon carbide plating of an inner cylindrical surface of a cylinder of an engine. Table 2 shows the results of tests for sectional hardness, adhesion strength, surface roughness after plating and synthetic evaluation of plating on the interior surface of the cylinder at various phosphorus concentrations in the plating liquid and phosphorus contents in the coating. The test conditions include a sodium concentration in the plating liquid of 3 grams per liter.

TABLE 2

| | Example | | | | | | |
|---|---|---|---|---|---|---|---|
| | | 1 | 2 | 3 | | | |
| | Comparative Example | | | | | | |
| | 1 | | | | 2 | 3 | 4 |
| Phosphorous Concentration in Plating Liquid (g/l) | 0 | 0.1 | 0.2 | 0.3 | 0.4 | 0.5 | 1.0 |
| Phosphorous Content in Plated Coating (wt %) | 0 | 0.55 | 0.65 | 0.98 | 1.40 | 1.58 | 3.14 |
| Sectional Hardness (Vickers Load: 100 gr) | | | | | | | |
| After plating | 554 poor | 620 good | 642 good | 675 good | 724 good | 724 good | 557 poor |
| After heat treatment (350° C., 1 hr) | 380 poor | 800 good | 850 good | 850 good | 850 good | 850 good | 750 poor |
| Adhesion Strength (5 rank evaluation) | 5 good | 5 good | 5 good | 5 good | 5 good | 4 fair | 2 poor |
| Surface Roughness after Plating (thickness: 100 μm) | RZ7.5 good | RZ18 good | RZ23 good | RZ30 good | RZ50 fair | | |
| Synthetic Evaluation | *1 | *2 | *2 | *2 | *1 | *1 | *1 |

*1: unacceptable
*2: acceptable

TABLE 3

| Phosphorous Content in Coating (wt %) | Pretreatment Method | Adhesion Test (5 rank evaluation) | Result |
|---|---|---|---|
| 0 | zinc substitution method | 4 | fair |
| 0.1 | high speed alumite method | 5 | good |
| 0.3 | zinc substitution method | 4 | fair |
| 0.5 | high speed alumite method | 5 | good |
| 0.9 | zinc substitution method | 3 | poor |
| 0.9 | high speed alumite method | 5 | good |
| 1.5 | high speed alumite method | 4 | fair |
| 4.0 | zinc substitution method | 2 | poor |

Examples 1, 2 and 3 of Table 2 each have a sectional hardness satisfactory for a plated coating on the interior surface of a cylinder (600 Hv or move after plating, and 800 Hv or more after heat treatment). Likewise, these examples exhibited a high adhesion strength, good surface roughness and a general overall acceptability.

Example 1 in which the phosphorus concentration in the plating liquid is 0.1 grams per liter and the phosphorus content in the plated coating is 0.55 percent by weight. On the other hand, in Example 1 where the phosphorus concentration and the phosphorus content were each 0, the sectional strength was insufficient so that the overall evaluation was unacceptable. Likewise, in comparative examples 2, 3 and 4, the surface roughness becomes worse and the adhesion strength lowers as the phosphorus content increases so that the overall evaluation is unacceptable.

Referring now to Table No. 3, there is illustrated the results of tests for adhesion strength at various phosphorus content in the plated coating. Again, the conditions are the same as the plating conditions of Table 2 except that a high speed alumite method and a zinc treatment method were utilized as a pretreatment method. As indicated in Table 3, the adhesion strength was better when the high speed alumite method was employed as the pretreatment method than it was where a zinc substitution method was employed. Table 3 also illustrates that adhesion decreased as the phosphorus content of the coating increased. The adhesion test strength test shown in both Tables 2 and 3 were carried out in accordance with the punching test (thickness of plated coating: 100 micrometers).

Figure 14:
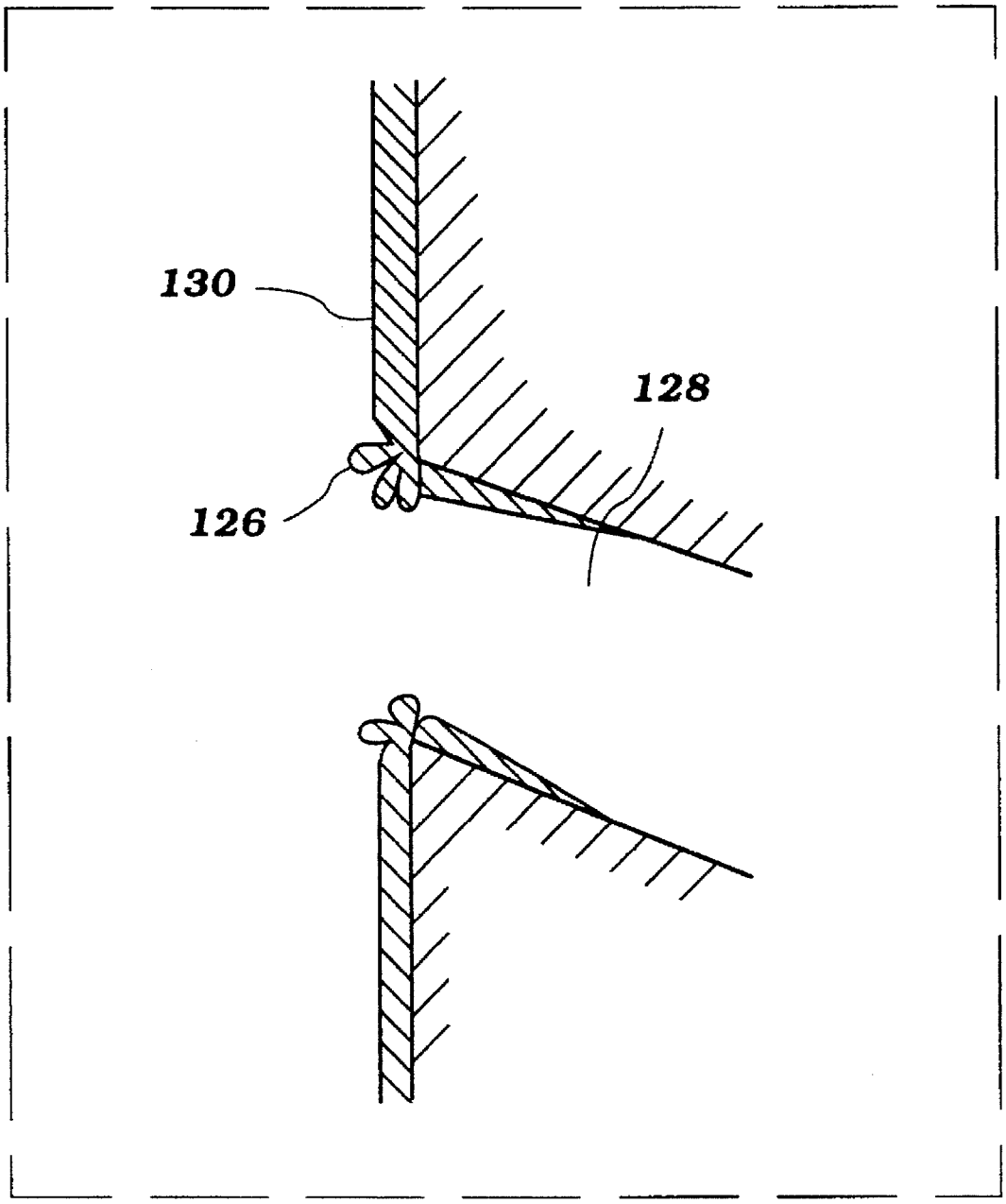
FIG. 14 is an enlarged view illustrating the edge effect of the plating when the phosphorous content in the plated coating is high.

The influence of the phosphorus content on the plated coating formed by the high speed plating technique of the present invention will now be discussed in greater detail. Specifically, when the phosphorus content is 1.0 percent by weight or more, the smoothness of the plated coating on the interior surface of the cylinder is adversely affected. As illustrated in FIG. 14, when a two-cycle engine cylinder having a cylinder peripheral wall provided with intake and exhaust ports is plated, a protruded flower-shaped portion 126 results around the port 128 in the plated coating 130 on the interior surface of the cylinder 132. Thus, it will be appreciated that the smoothness is considerably deteriorated. This deterioration in surface roughness may be so bad that it necessitates dramatically increased finishing time to hone the workpiece. As will be appreciated, it would be desirable to minimize the man hours required for the honing step by minimizing the thickness of the plated coating. While in coating having a highly accurate thickness is obtained through high speed plating, when the phosphorus content is 1.0 percent by weight or more, the surface roughness of the plated surface is adversely affected. On the other hand, when the phosphorus content is excessively small, the hardness of the plated coating is lowered. To satisfy the requirements for hardness, the phosphorus content of the plating liquid should be 0.50 percent by weight or more. Accordingly, when a nickel plating coating is formed on an interior surface of a cylinder by high speed plating treatment, the phosphorus content is preferably in the range of 0.50–0.98 percent by weight.

The plating liquid and method of the present invention are desirably used in connection with an improved plating system liquid, the details of which are set forth in a U.S. patent application entitled "Surface Treatment Device," Ser. No. 08/299,834, now U.S. Pat. No. 5,552,026, filed on even date herewith (claiming priority from Japanese Patent Application No. 218755, filed Sep. 2, 1993), which is hereby incorporated herein by reference. Further, the liquid and method of the present invention may also be used in connection with a modified plating system, the details of which are set forth in a U.S. patent application entitled "Surface Treatment Device," Ser. No. 08/299,518, now U.S. Pat. No. 5,580,383, filed on even date herewith (claiming priority from Japanese Patent Application No. 218754, filed Sep. 2, 1993), which is also hereby incorporated herein by reference.

It will be understood by those of skill in the art that numerous variations and modifications can be made without departing from the spirit of the present invention. Therefore, it should be clearly understood that the forms of the present invention are illustrative only and are not intended to limit the scope of the present invention.

We claim:

1. A method for forming a plating coating on a circumferential inner surface of a workpiece, comprising the steps of:

(a) placing a hollow electrode having an end within said circumferential inner surface, wherein an inner passage of plating liquid is formed inside said hollow electrode, and an outer passage of plating liquid is formed between said hollow electrode and said circumferential inner surface of said workpiece, said inner passage and said outer passage being communicated via said end of said hollow electrode;

(b) permitting a plating liquid containing nickel and a dispersed substance-forming material, to flow at a flow rate of 1.0–3.0 m/see through said outer passage and said inner passage via said end of said hollow electrode, said plating liquid containing sodium at a concentration of 2–3.5 g/l, and phosphorous at a concentration such that the phosphorus content of a plating coating when formed is 0.5% or more but less than 1.0% by weight of the plating coating; and (c) impressing a voltage between said circumferential inner surface and said electrode to give an electric current density therebetween sufficient to form on said circumferential inner surface of the workpiece a plating coating containing a dispersed substance and phosphorous, said phosphorous being in an amount of 0.5% or more but less than 1.0% by weight of the plating coating.

2. A method according to claim 1, wherein, in step (c), the electric current density is 20–200 A/dm$^2$.

3. A method according to claim 2, wherein, in step (c), the electric current density is approximately 100 A/dm$^2$.

4. A method according to claim 1, wherein, in step (b), said nickel plating liquid is formed with nickel sulfamate or nickel sulfate.

5. A method according to claim 1, wherein, in step (b), the phosphorous concentration in said plating liquid is 0.1–0.3 g/l.

6. A method according to claim 1, wherein, in step (b), said plating liquid has a temperature of 65°–80° C. and a pH of 3.0–4.5.

7. A method according to claim 1, wherein, in step (b), the sodium concentration is such that the plating coating is deposited at a rate of 20–30 μ/min as measured when the dispersed substance is in an amount of 2.5% by weight of the plating coating.

* * * * *